US005430528A

United States Patent [19]

Kumasaka et al.

[11] Patent Number: 5,430,528

[45] Date of Patent: Jul. 4, 1995

[54] MAGNETIC BRUSH WITH BRISTLE HEIGHT EQUAL TO DEVELOPING GAP

[75] Inventors: Takao Kumasaka, Takahagi; Yuzuru Simazaki; Shigetaka Fujiwara, both of Hitachi; Isamu Komatsu, Takahagi; Youji Hirose, Mito, all of Japan

[73] Assignees: Hitachi, Ltd.; Hitachi Koki Co. Ltd., both of Tokyo, Japan

[21] Appl. No.: 545,576

[22] Filed: Jun. 29, 1990

[30] Foreign Application Priority Data

Jul. 3, 1989 [JP] Japan ..... 1-169823
Mar. 19, 1990 [JP] Japan ..... 2-66911

[51] Int. Cl.[6] ..... G03G 15/09
[52] U.S. Cl. ..... 355/251; 118/658
[58] Field of Search ..... 355/251, 253, 259, 245, 355/246; 118/656, 657, 658

[56] References Cited

U.S. PATENT DOCUMENTS

| | | | |
|---|---|---|---|
| 4,576,465 | 5/1986 | Fushida et al. | 118/658 X |
| 4,822,711 | 4/1989 | Haya et al. | 118/658 X |
| 4,873,551 | 10/1989 | Tojima et al. | 355/251 |
| 4,947,200 | 8/1990 | Kumasaka et al. | 355/251 |
| 4,949,127 | 8/1990 | Matsuda et al. | 355/251 |
| 4,990,968 | 2/1991 | Kusuda | 355/327 X |
| 5,038,176 | 8/1991 | Yokoyama et al. | 355/251 |
| 5,054,419 | 10/1991 | Haya et al. | 118/657 |

FOREIGN PATENT DOCUMENTS

| | | | |
|---|---|---|---|
| 54-7539 | 1/1979 | Japan . | |
| 57-173764 | 4/1982 | Japan . | |
| 0225265 | 9/1988 | Japan | 355/253 |

*Primary Examiner*—Leo P. Picard
*Assistant Examiner*—Christopher Horgan
*Attorney, Agent, or Firm*—Antonelli, Terry, Stout & Kraus

[57] ABSTRACT

In a developing apparatus in which a developer containing magnetic particles is carried on a developer carrier to form a magnetic brush and a latent image on a latent image carrier opposing the developer carrier is developed by the magnetic brush, the magnetic brush bristle height and the developing gap are controlled to keep density of a first color image and density of a second and the ensuing color images in color development at predetermined values or more, thereby maintaining quality of printed images stably. There are also provided method and apparatus of measuring the bristle height of the magnetic brush of the developing apparatus, which bristle height is a parameter indispensable for control of the above developing condition, under the dynamic condition that the developing roller rotates.

79 Claims, 9 Drawing Sheets

MAGNETIC BRUSH WITH BRISTLE HEIGHT EQUAL TO DEVELOPING GAP

BACKGROUND OF THE INVENTION

This invention relates to a developing method or a developing bristle height measuring method and apparatus practicing the methods as well as color image printers.

Various types of color toner image printing method and color toner image printer using electrophotography have been proposed; and from the standpoint of speed-up and continuous paper recording specification, method and apparatus of the type wherein a color toner image is formed on the surface of a rotating sensitive member (sensitive drum or sensitive belt) and the color image is transferred to a recording paper are highly evaluated.

In this type of printer using, for example, a sensitive drum, a plurality of pairs of electrostatic latent image forming means and developing means are arranged in the direction of rotation of the sensitive drum to oppose the same and development is repeated plural times in order to form toner images of a plurality of kinds of color at one image forming area. In this printer, however, development for the second color is done at the surface of the sensitive drum where a first color toner image is formed; and, if a developing means of contact type is used for the second color, the first color toner image is scraped off by the developing means for the second color and decreased in image density, and besides the scraped-off first color toner intrudes into the second color developing means, causing color mixing. This problem also takes place in the third and the following developing means.

Approaches to this problem have been proposed wherein a contactless magnetic brush or a magnetic brush of weak slide-contact force is used for the succeeding developing means.

This type of printer is disclosed in, for example, Japanese Patent Publication No. 63-43748, JP-A-52-106743 and JP-A-56-144452.

The prior art printer, however, does not consider how the developing gap should be related to the bristle height of a magnetic brush for the purpose of obtaining excellent color images, and it faces difficulties in insuring sufficient image density of both the first and second color toner images. More specifically, the maintenance of image density of the first color toner image tends to cause a decrease in image density or irregularity in density of the second color toner image and conversely, the maintenance of image; density of the second color toner image tends to cause occurrence of fog or a decrease in image density of the first color toner image. Disadvantageously, the prior art apparatus does not consider a change in image density due to a slight change with time in developing conditions, either and is difficult to maintain quality of printed images stably.

SUMMARY OF THE INVENTION

An object of the present invention is to provide a method and apparatus which can keep a toner image density above a predetermined value of both the first and second color toner images when forming color images.

Another object of the invention is to provide a method and means for adjusting the bristle height of a magnetic brush of the developing means and the developing gap to set up the relative relationship therebetween which is suitable for attainment of the uniformity in image density.

According to a first embodiment of the invention, in a developing method in which a developer containing magnetic particles is carried on a developer carrier to form a magnetic brush and a latent image on a latent image carrier opposing the developer carrier is developed by the magnetic brush, the bristle height of the magnetic brush is made to be substantially equal to the developing gap.

According to a second embodiment, in a developing method in which a second latent image on a latent image carrier having thereon a first toner image formed by developing a first latent image is developed by a magnetic brush formed of a developer containing magnetic particles on a developer carrier to form a second toner image, the bristle height of the magnetic brush is made to be substantially equal to the developing gap upon development for formation of the second toner image. The first development is not limited to a magnetic brush.

According to a third embodiment, in a developing method in which an electrically conductive developer containing magnetic particles is carried on a developer carrier to form a magnetic brush and a latent image on a latent image carrier opposing the developer carrier is developed by the magnetic brush, the bristle height of the magnetic brush and the developing gap are so set that electrical resistance between the developer carrier and latent image carrier due to the magnetic brush interposed between the developer carrier and latent image carrier has a value near a point of inflection on a curve representative of change of the electrical resistance.

According to a fourth embodiment, in a developing method in which a second latent image on a latent image carrier having thereon a first toner image formed by developing a first latent image is developed by a magnetic brush formed of a developer containing magnetic particles on a developer carrier to form a second toner image, the bristle height of the magnetic brush and the developing gap are so set that electrical resistance between the developer carrier and latent image carrier due to the magnetic brush interposed between the developer carrier and latent image carrier has a value near a point of inflection on a curve representative of change of the electrical resistance.

According to a fifth embodiment, in a developing method in which a developer containing magnetic particles is carried on a developer carrier to form a magnetic brush and a latent image on a latent image carrier opposing the developer carrier is developed by the magnetic brush, the bristle height of the magnetic brush and the developing gap are so set that frictional force exerted by the magnetic brush on the latent image carrier has a value near a point of inflection on a curve representative of change of the frictional force.

According to a sixth embodiment, in a developing method in which a second latent image on a latent image carrier having thereon a first toner image formed by developing a first latent image is developed by a magnetic brush formed of a developer containing magnetic particles on a developer carrier to form a second toner image, the bristle height of the magnetic brush and the developing gap are so set that frictional force exerted by the magnetic brush on the latent image carrier has a value near a point of inflection on a curve representative of change of the frictional force.

According to a seventh embodiment, in a developing method in which a developer containing magnetic particles is carried on a developer carrier to form a magnetic brush and a latent image on a latent image carrier opposing the developer carrier is developed by the magnetic brush, the bristle height of the magnetic brush is so controlled that developing density exceeds a predetermined value.

According to an eighth embodiment, in a developing method in which a second latent image on a latent imager carrier having thereon a first toner image formed by developing a first latent image is developed by a magnetic brush formed of a developer containing magnetic particles on a developer carrier to form a second toner image, the bristle height of the magnetic brush is so controlled that density levels for the first and second developments exceed predetermined values.

According to a ninth embodiment, in a developing method in which a developer containing magnetic particles is carried on a developer carrier to form a magnetic brush and a latent image on a latent image carrier opposing the developer carrier is developed by the magnetic brush, the developing gap is so controlled that developing density exceeds a predetermined value.

According to a tenth embodiment, in a developing method in which a second latent image on a latent image carrier having thereon a first toner image formed by developing a first latent image is developed by a magnetic brush formed of a developer containing magnetic particles on a developer carrier to form a second toner image, the developing gap is so controlled that density levels for the first and second developments exceed predetermined values.

According to an eleventh embodiment, in a color image printing method in which a first latent image on a latent image carrier is developed by a first magnetic brush formed of a first developer containing magnetic particles on a first developer carrier to form a first toner image and a second latent image on the latent image carrier formed with the first toner image is developed by a second magnetic brush formed of a second developer containing magnetic particles on a second developer carrier to form a second toner image, the bristle height of the second magnetic brush is made to be substantially equal to the developing gap upon development for formation of the second toner image.

According to a twelfth embodiment, in a color image printing method in which a first latent image on a latent image carrier is developed by a first magnetic brush formed of a first developer containing magnetic particles on a first developer carrier to form a first toner image and a second latent image on the latent image carrier formed with the first toner image is developed by a second magnetic brush formed of a second developer containing magnetic particles on a second developer carrier to form a second toner image, the magnetic brush bristle height is made to be substantially equal to the developing gap upon developments for formation of the first and second toner images.

According to a thirteenth embodiment, in a developing apparatus comprising a developer carrier for carrying a developer containing magnetic particles to form a magnetic brush, and means for forming a developing gap through which the magnetic brush opposes a latent image carrier carrying a latent image so that the latent image may be developed by the magnetic brush, means is provided for making the bristle height of the magnetic brush substantially equal to the developing gap.

Since the bristle height of the magnetic brush formed of the developer for developing a second latent image on the latent image carrier formed with first and second latent images is so set as to be substantially equal to the developing gap, the tip of the magnetic brush slightly contacts or does not contact to the surface of the latent image carrier to develop the second latent image, thereby forming a second toner image. Accordingly, a first toner image formed precedently will not be scraped off to prevent a decrease in image density and the first toner will not intrude into the second developing unit to prevent color mixing and occurrence of fog, making it possible to provide the second toner image of sufficient density.

Therefore, the present invention can provide method and apparatus which can keep uniform image density of both the first and second color toner images when forming color images, and besides can provide a method and means for adjusting the bristle height of a magnetic brush of the developing means, to set up a relative relationship between the bristle height and the developing gap which is suitable for attainment of the uniformity in image density.

With the method and apparatus of the invention, developing conditions optimized for obtaining desirable image density stably can be set so that a change with time in image density may be alleviated, making it easy to maintain quality of printed image stably.

DESCRIPTION OF THE PREFERRED EMBODIMENTS

The invention will now be described by way of example with reference to the accompanying drawings.

Figure 1:
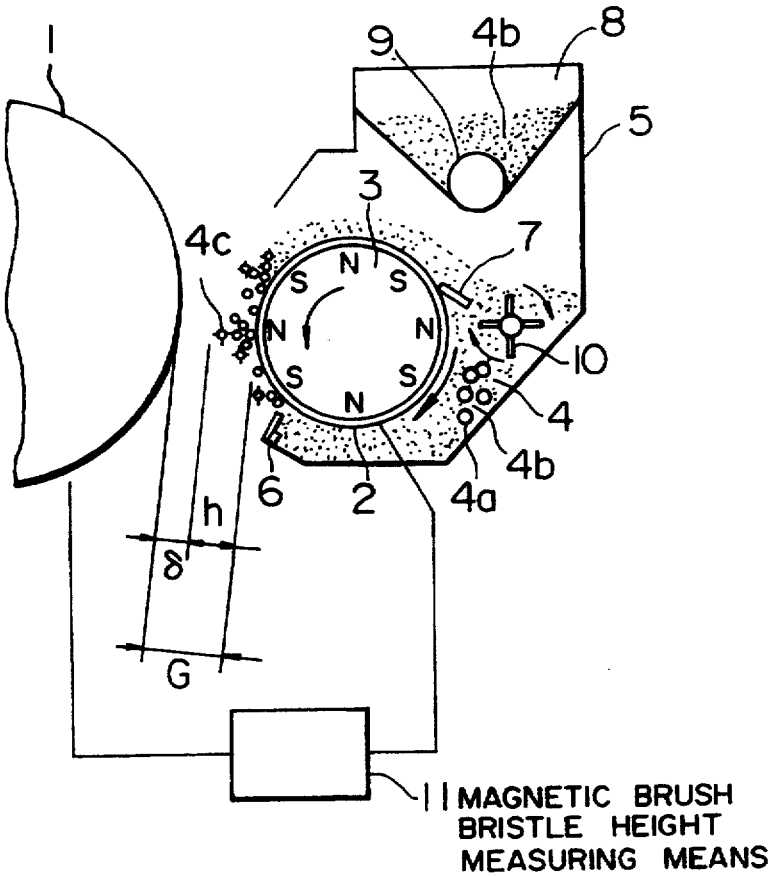
FIG. 1 is a side view showing a first embodiment of a developing apparatus according to the invention.

FIG. 1 illustrates a first embodiment of a developing apparatus of the invention in which a developing sleeve 2 opposing the surface of an electronograph sensitive drum 1 with a predetermined developing gap interposed therebetween is made of a nonmagnetic and electrically conductive material and a rotatable magnet roller 3 is comprised in a space inside the developing sleeve. A developer 4 is a mixture of carrier 4*a* and toner 4*b* of coloring granules and is stored in a developing container 5. The developer is adsorbed on the surface of the developing sleeve 2 by means of the magnet roller 3 to form a magnetic brush 4*c*. As the developing sleeve 2 is rotated clockwise and the magnet roller 3 counterclockwise, the magnetic brush 4*c* on the developing sleeve 2 rotates clockwise. A regulator plate 6 regulates the amount of particles of developer 4 which is adsorbed on the surface of the developing sleeve 2 and is rotated, and a scraper 7 scrapes off the developer 4 adsorbed on the surface of the developing sleeve 2 and rotated so that scraped-off developer may be collected in the developing container 5. Disposed above the developing container 5 is a toner hopper 8 in which granules of toner 4*b* are stored so as to be replenished to the developing container 5 by the action of a replenishment roller 9. A stirring means 10 is adapted to stir and convey the developer 4 scraped off from the surface of the developing sleeve 2 by the scraper 7 and the toner 4*b* replenished from the hopper 8.

In the apparatus constructed as above, the developing gap defining a gap between the surfaces of sensitive drum 1 and developing sleeve 2 and the height of bristles (called bristle height hereinafter) of the magnetic brush 4*c*, formed of the developer 4 and appearing in the developing gap, are adjusted relatively such that the value, G, of the developing gap substantially equals the value, h, of the bristle height. Under this condition, a bias voltage is applied between the sensitive drum 1 and the developing sleeve 2 to develop a latent image formed on the surface of the sensitive drum 1.

Preferably, for measurement and adjustment of the relative relationship between the magnitude of developing gap G and the bristle height of the magnetic brush 4*c* formed of developer 4, the following procedure may be taken.

More particularly, the developer 4 (carrier 4*a*) is made to be electrically conductive or semiconductive, and the developing sleeve 2 is adjustably supported to permit adjustment of the developing gap while being in electrically insulated state. Then, voltage is applied across the sensitive drum 1 (or an electrode disposed at a position corresponding to that of the sensitive drum) and the developing sleeve 2 and the bristle height is measured in terms of the magnitude of current flowing through them by means of a magnetic brush bristle height measuring means 11.

Figure 2:
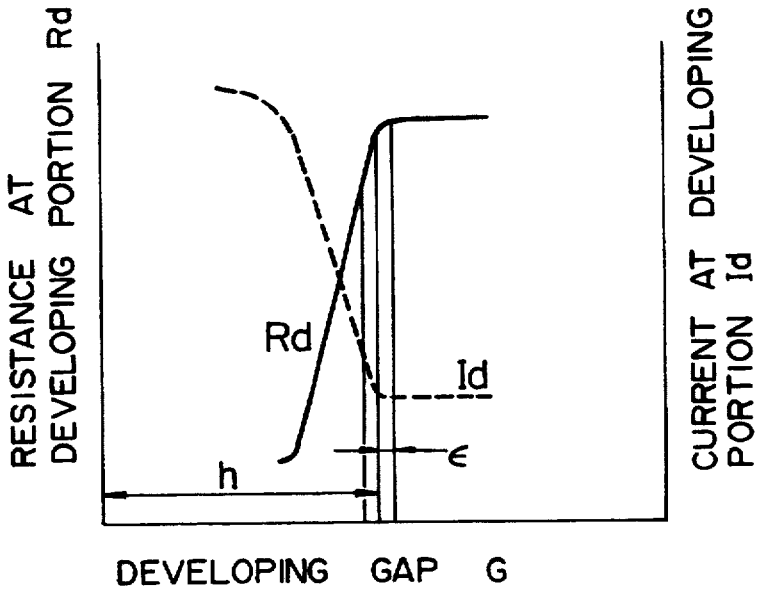
FIG. 2 is a graph showing how resistance and current at the developing portion are related to the developing gap when the magnetic brush bristle height is maintained at a predetermined value.

In the apparatus having the above construction, current flow Id at the developing portion between the sensitive drum 1 and developing sleeve 2 sets up a current which flows through the magnetic brush 4*c* formed of the developer 4 and appearing between the sensitive drum 1 and developing sleeve 2 and which changes as shown in FIG. 2 when the magnitude of the developing gap G is changed. In particular, FIG. 2 demonstrates that when the magnitude of the developing gap G is changed while maintaining the bristle height of the magnetic brush 4*c* at a constant value, the contact condition between the bristle of magnetic brush 4*c* and the sensitive drum 1 is changed to change resistance Rd of an electric circuit established by the magnetic brush 4*c* between the sensitive drum 1 and the developing sleeve 2. Especially, a point of inflection at which the resistance Rd begins to decrease from the maximum level (or a point inflection at which the developing current Id begins to increase from the minimum level) takes place at a value of the developing gap G which substantially equals the magnetic brush bristle height h. Thus, this value of the developing gap can be prescribed to be the bristle height h.

Specifically, when the developing gap G is so set as to fall within a range;

$$h-\epsilon \leqq G \leqq h+\epsilon$$

$$\epsilon \fallingdotseq 0.3 \text{ mm}$$

desirable image density can be obtained. This range would include where $-0.3 \text{ mm} \leqq G-h \leqq 0$.

It will further be appreciated that other preferable developing conditions for obtaining desirable image density under the above relative relationship between the developing gap G and bristle height h are the rotation speed of developing sleeve 2 being 100 to 300 rpm, the rotation speed of magnet roller 3 being 100 to 500 rpm and the gap between the developing sleeve 2 and the regulator plate 6 (regulator plate gap) being 0.1 to 0.5 mm. The number of magnetic poles of the magnet roller 3 is 16 to 30. The carrier 4*a*, one of the constituents of the developer 4, may be ferrite particles, or resin powder including iron powder or magnetic fine powder iron powder or resin powder, having an average particulate size of 10 to 70 μm. In case where developing bias voltage Vb is DC bias voltage of the same polarity as that of electric charge on the toner 4b in order to perform inversion development, $$Vo-100 \geqq Vb \geqq Vo-200$$

is valid, where Vo is the surface potential on the sensitive drum 1.

Figure 3:
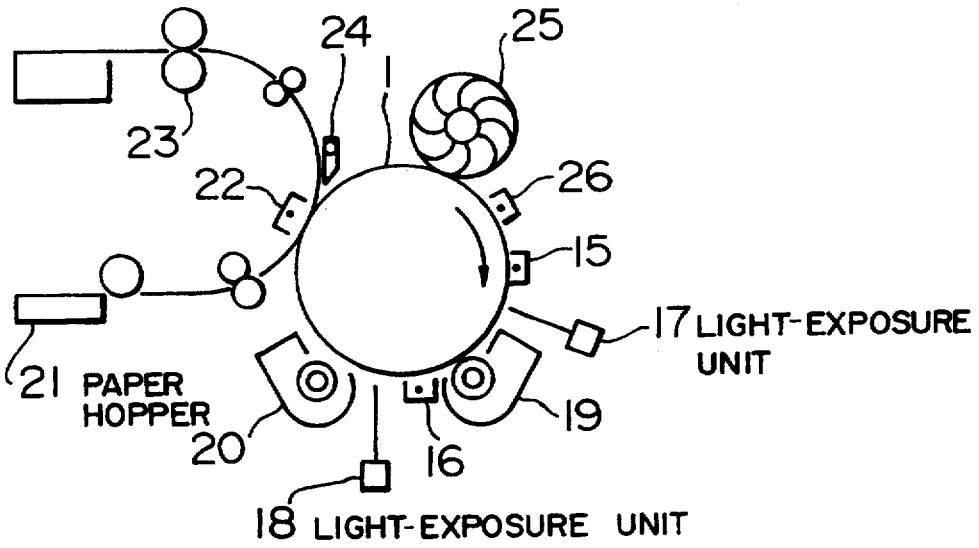
FIG. 3 is a side view showing an embodiment of a two-color image printer of the invention using the FIG. 1 apparatus as a second developing unit.

FIG. 3 schematically illustrates a two-color image printer using the aforementioned developing apparatus as a second developing unit.

The printer comprises a first imaging system and a second imaging system which oppose the outer circumferential surface of the sensitive drum 1, the first system including a first charger 15, a first light-exposure unit 17 and a first developing unit 19 which are sequentially arranged in the direction of rotation of the sensitive drum 1 and the second system including a second charger 16, a second light-exposure unit 18 and the second developing unit 20 which are also arranged sequentially in the rotational direction of the sensitive drum 1. In the printer having the above construction, a two-color toner image is formed on the surface of the sensitive drum 1, and the two-color toner image is transferred, by means of a transfer unit 22, to a recording paper fed from a paper hopper 21 and fixed by means of a fixing unit 23. Denoted by 24 is a peel-off member for peeling off the recording paper adsorbed on the surface of the sensitive drum 1, 25 a toner cleaner and 26 a discharger.

The second developing unit 20 measures a bristle height h2 in accordance with the magnetic brush bristle height measuring method described previously and based on a measured value, sets a developing gap G2 pursuant to the following formulas as in the precedence:

$$h2-\epsilon 2 \leqq G2 \leqq h2+\epsilon 2$$

$$\epsilon 2 \fallingdotseq 0.3 \text{ mm}$$

In the two-color image printer constructed as above, the surface of the sensitive drum 1 is first charged uniformly by the first charger 15 and thereafter a first image exposure is carried out by the first light-exposure unit 17 to form a first latent image on the surface of the sensitive drum 1. In the first developing unit 19, the magnetic brush formed of the developer slide-contacts the surface of the sensitive drum 1 to develop the first latent image, providing a first color toner image.

The second charger 16 again charges uniformly the surface of the sensitive drum 1 thus formed with the first color toner image. The second light-exposure unit 18 carries out a second image exposure to form a second latent image on the surface of the sensitived drum 1. In the second developing unit 20, the magnetic brush of the developer slide-contacts the surface of the sensitive drum 1 to develop the second latent image, providing a second toner image.

The paper hopper 21 feeds a recording paper onto which the two-color toner image thus formed on the surface of the sensitive drum 1 is to be transferred. The recording paper moves while making contact to the surface of the sensitive drum 1 and the transfer unit 22 applies transfer charge on the back of the recording paper making contact to the surface of the sensitive drum 1 so as to electrostatically transfer the two-color toner image formed on the surface of the sensitive drum 1 onto the recording paper. The recording paper with the thus transferred two-color toner image is peeled off from the surface of the sensitive drum 1 by means of the peel-off member 24 and then conveyed to the fixing unit 23. The fixing unit 23 heats the two-color toner image so as to fix it on the recording paper by fusion.

After completion of the toner image transfer, the surface of the sensitive drum 1 is removed of the remainder of toner by the toner cleaner 25 and of the remaining electric charge by the discharger 26 and is then used for the next image printing.

Figure 4:
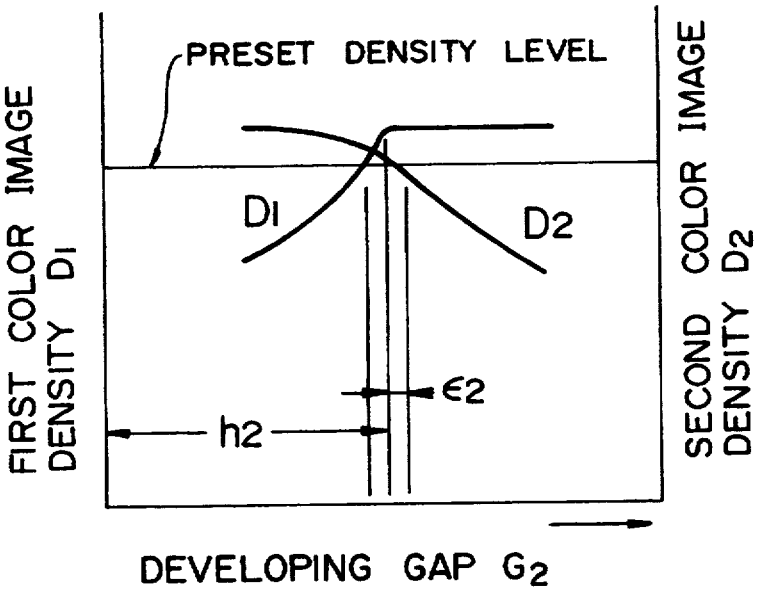
FIG. 4 is a graph showing how image density of a first color toner image and that of a second color toner image are related to the developing gap in the developing unit when the magnetic brush bristle height is maintained at a predetermined value.

Referring now to FIG. 4, image density D1 of the first color toner image and image density D2 of the second toner image will be described.

For the second developing unit 20 having the magnetic brush bristle height maintained at h2, the developing gap G2 is related to the image density D1 of the first color toner image and the image density D2 of the second color toner image as graphically shown in FIG. 4.

In the region where the developing gap G2 of the second developing unit 20 is narrower than the bristle height h2, the magnetic brush scrapes off the first color toner image present on the surface of the sensitive drum 1 when the second developing unit 20 develops the second latent image and consequently, the image density D1 of the first color toner image decreases. The image density D1 of the first color toner image increases as the developing gap G2 increases and in the region where the developing gap G2 exceeds the bristle height h2, it is saturated because the contactless status is established between the magnetic brush and sensitive drum.

On the other hand, the image density D2 of the second color toner image obtained when the second developing unit 20 develops the second latent image decreases gradually as the developing gap G2 increases in the contact region where the developing gap G2 is narrower than the bristle height H2 and it decreases rapidly as the developing gap G2 increases in the non-contact region where the developing gap G2 is wider than the bristle height h2.

In the two-color image printer, however, the developing gap G2 is so set as to be substantially equal to the magnetic brush bristle height h2 and therefore the image density D1 and the image density D2 of the two toner images can both exceed a preset value.

Figure 5:
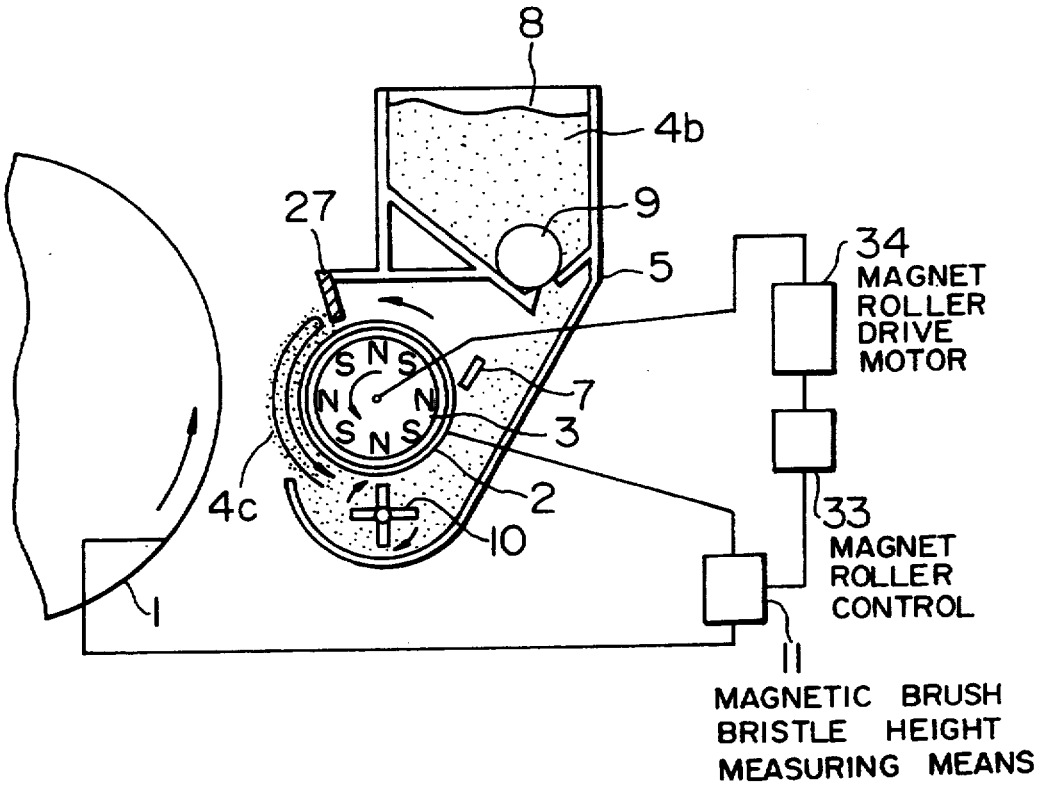
FIG. 5 is a side view showing a second embodiment of the developing apparatus according to the invention in which desirable image density can be obtained by adjusting the bristle height of the magnetic brush formed of developer.

Referring now to FIG. 5, a second embodiment of the developing apparatus will be described wherein desirable image density can be obtained by adjusting the bristle height of a magnetic brush formed of developer. Components like those of the developing apparatus described previously will be designated by like reference numerals and will not be detailed here.

In the FIG. 5 developing apparatus, a developing sleeve 2 and a magnet roller 3 are both rotated counterclockwise, a stirring means 10 is disposed beneath the developing sleeve 2 and a stopper 27 disposed above the developing sleeve 2 opposes the surface of the developing sleeve 2 to block the flow of the developer (rotation of the magnetic brush).

Figure 6:
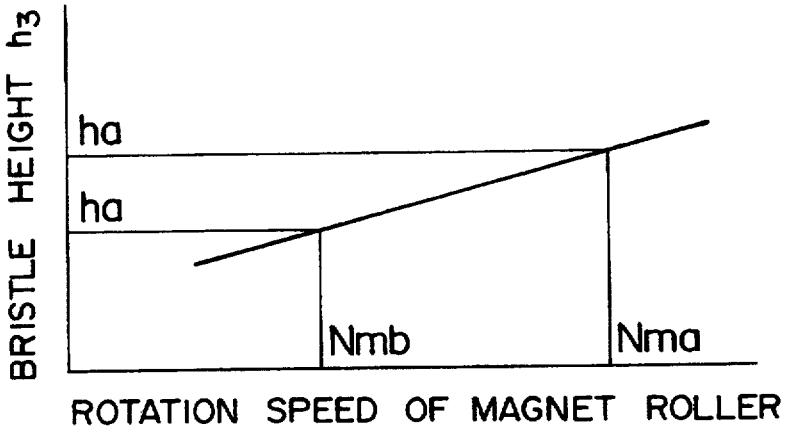
FIG. 6 is a graph showing the relation between the magnetic brush bristle height and the magnet roller rotation speed in the FIG. 5 apparatus.

With the above construction, as the developing sleeve 2 and magnet roller 3 rotate, a magnetic brush 4c formed of developer 4 and appearing on the surface of the developing sleeve 2 is divided into an upper formation rotating clockwise and a lower formation rotating counterclockwise. The upper formation is formed of developer 4 fed from a developing container 5 under the influence of rotational force due to magnetic force generated by the magnet roller 3, and the lower formation is created under the influence of rotational force due to frictional force against the developing sleeve 2 generated when the rotation of the upper formation is blocked by the stopper 27. For example, with the rotation speed of the developing sleeve 2 kept to be constant, the bristle height $h_3$ of the magnetic brush 4c can be changed as shown in FIG. 6 by controlling the rotation speed of the magnet roller 3.

Figure 7:
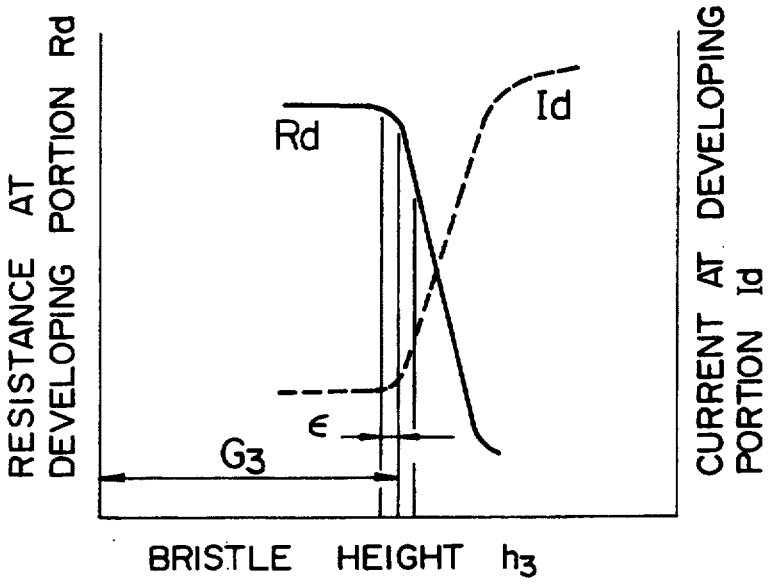
FIG. 7 is a graph showing how resistance and current at the developing portion are related to the magnetic brush bristle height in the FIG. 5 apparatus when the developing gap is maintained at a predetermined value.

A magnetic brush bristle height measuring means 11 measures, in the previously-described manner, characteristics as shown in FIG. 7 which relate to the bristle height and developing portion resistance or the bristle height and developing portion current, finds out the bristle height $h_3$ equal to the developing gap G3 on the basis of the measurement results, and controls the rotation speed of a magnet roller drive motor 34 through a magnet roller control 33 so as to adjust the bristle height of the magnetic brush 4c such that the bristle height $h_3$ substantially equals the developing gap G3.

The bristle height adjustment in this embodiment is effected by changing the rotation speed of the magnet roller 3 while keeping the rotation speed of the developing sleeve 2 constant but conversely, it may be achieved by changing the rotation speed of the developing sleeve 2 while keeping the rotation speed of the magnet roller 3 constant. The latter case provides such a characteristic that as the rotation speed of the developing sleeve 2 increases, the bristle height $h_3$ is decreased.

Figure 8:
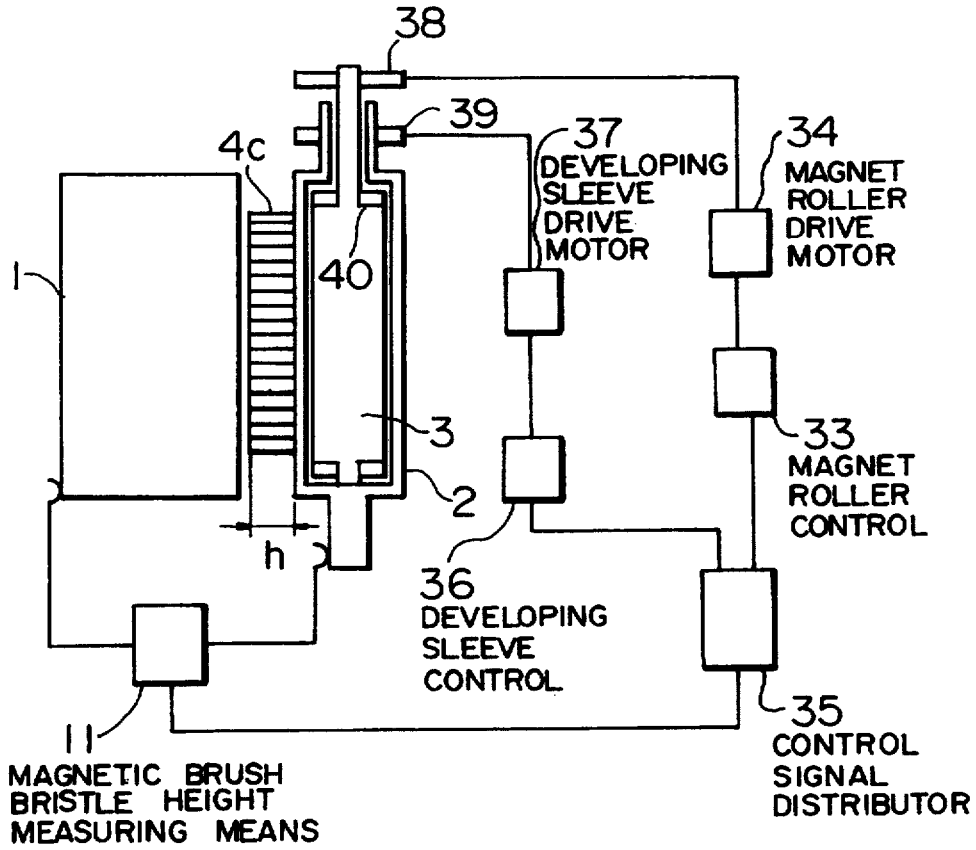
FIG. 8 is a plan view showing a third embodiment of the developing apparatus according to the invention in which the relative relationship between the developing gap and bristle height is adjusted by controlling rotation speeds of both the developing sleeve and magnet roller.

FIG. 8 illustrates a third embodiment of the developing apparatus in which the relative relationship between developing gap G and bristle height h can be adjusted to the optimum condition by controlling rotation speeds of both the developing sleeve and magnet roller. A magnetic brush bristle height measuring means 11 measures the relative relationship between the developing gap G and bristle height h in the same measuring manner as that described previously. A control signal distributor 35 controls a control signal fed to a magnet roller control 33 operable to control the rotation speed of a magnet roller drive motor 34 and a control signal fed to a developing sleeve control 36 operable to control the rotation speed of a developing sleeve drive motor 37, thereby ensuring that the bristle height h of the magnetic brush 4c can be so adjusted as to substantially equal the developing gap G. Denoted by 38 and 39 are drive force transmission mechanisms comprised of gears and pulleys and 40 a bearing.

Figure 9:
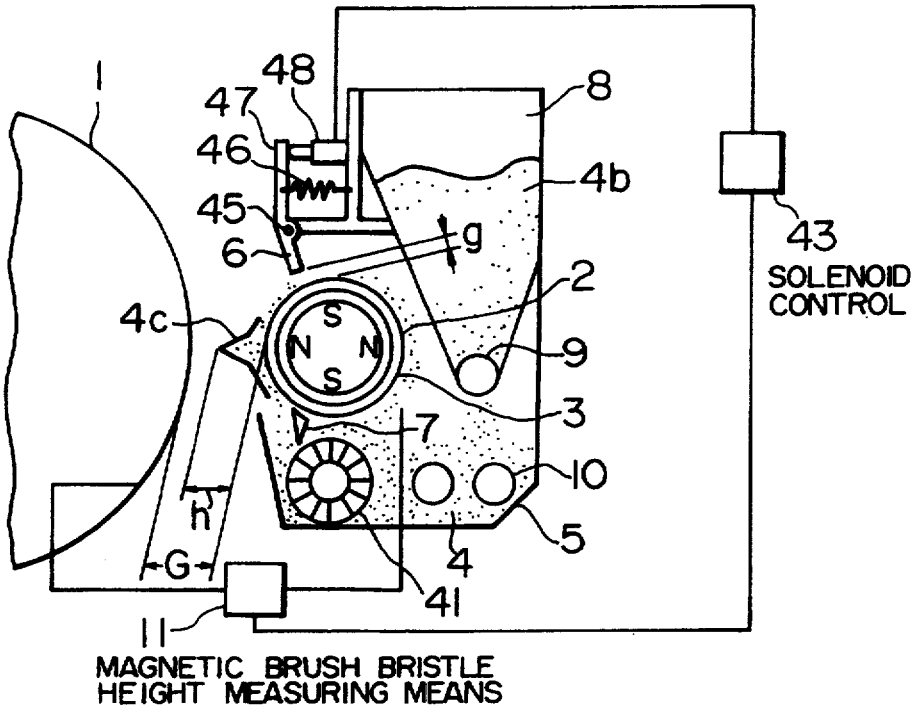
FIGS. 9 and 10 are side views showing fourth and fifth embodiments of the developing apparatus according to the invention in which the magnetic brush bristle height is adjusted by controlling the regulator plate gap.

FIG. 9 illustrates a fourth embodiment of the developing apparatus in which the magnetic brush bristle height can be adjusted by controlling the regulator plate gap. In the developing apparatus, developer 4 in a developing container 5 is stirred by a stirring means (stirring screw propeller) 10 and then pumped up by a convey bucket 41 so as to be fed to the surface of a developing sleeve 2. The developer 4 is then adsorbed on the developing sleeve 2 to form a magnetic brush 4c while rotated counterclockwise. A bristle height h of the magnetic brush 4c acting on a sensitive drum 1 can be determined by a regulator plate gap g as in the case of the developing apparatus described with reference to FIG. 1. In the FIG. 9 apparatus, for adjustment of the regulator plate gap g, a regulator plate 6 is secured to one end of an arm 47 rotatably supported on a pivot 45 and the other end of the arm 47 is urged against a solenoid type telescopic rod 48 by the action of a tension spring 46, whereby the regulator plate gap g can be changed by actuating the solenoid type telescopic rod 48 to rotate the arm 47. The actuation control of the solenoid type telescopic rod 48 can be realized by measuring the relative relationship between developing gap G and bristle height h by means of a magnetic brush bristle height measuring means 11 and controlling solenoid drive current on the basis of the results of the measurement by means of a solenoid control 43.

Figure 10:
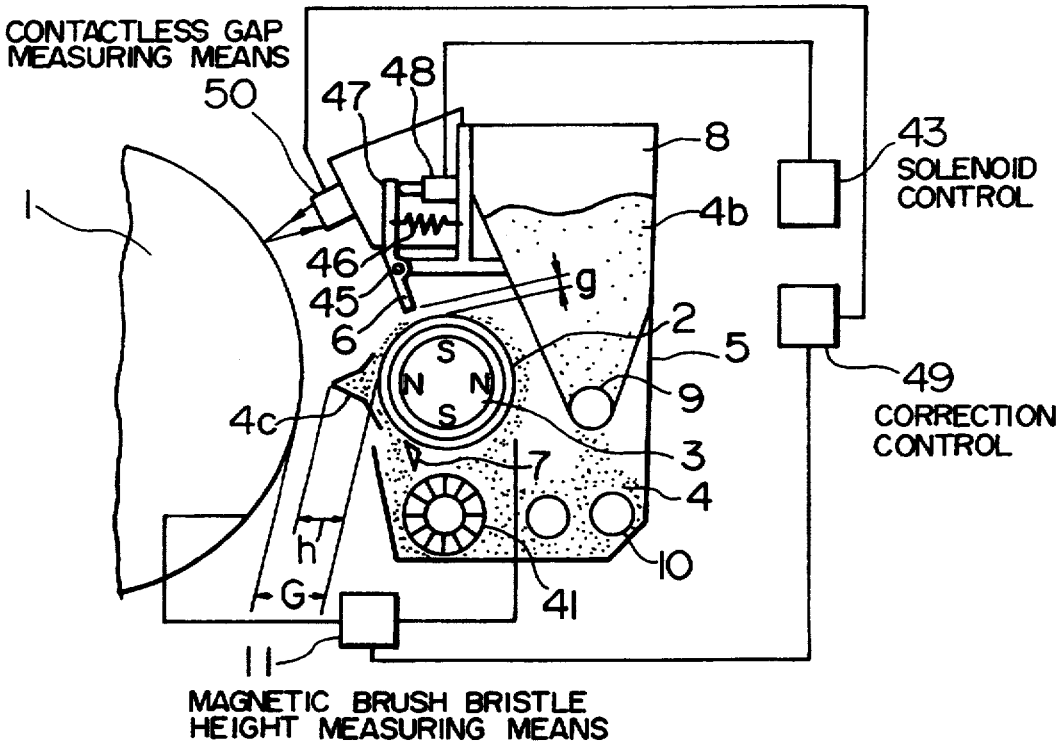

FIG. 10 shows a fifth embodiment of the developing apparatus directed to an improvement in the developing apparatus described with reference to FIG. 9. The FIG. 10 apparatus comprises, in addition to a magnetic brush bristle height measuring means similar to that described previously, a contactless gap measuring means for measuring the distance between the developing apparatus and the sensitive drum, so that a bristle height h may be controlled on the basis of measurement results obtained from the two measuring means. The contactless gap measuring means as designated at 50 is mounted to a developing container 5 to oppose the surface of a sensitive drum 1 and is operable to measure, at a position upstream of the developing position, the gap on the basis of the state of reflection of light irradiated on the surface of the sensitive drum 1. A detection signal produced from the contactless gap measuring means 50 is fed to a correction control 49 which in turn corrects a detection signal produced from the magnetic brush bristle height measuring means 11 to provide a correction signal applied to a solenoid control 43.

Measurement by the magnetic brush bristle height measuring means 11 is effected at the developing portion and feedback control based on only the results of that measurement causes a delay in control. However, thanks to the provision of the contactless gap measuring means 50 capable of measuring the gap between the developing apparatus and sensitive drum in advance, it is possible to make the magnetic brush bristle height control operation accurately follow a variation in developing gap G due to, for example, eccentricity of the sensitive drum 1. In addition, the detection signal delivered out of the contactless gap measuring means 50 can also be used for checking the control state.

Figure 11:
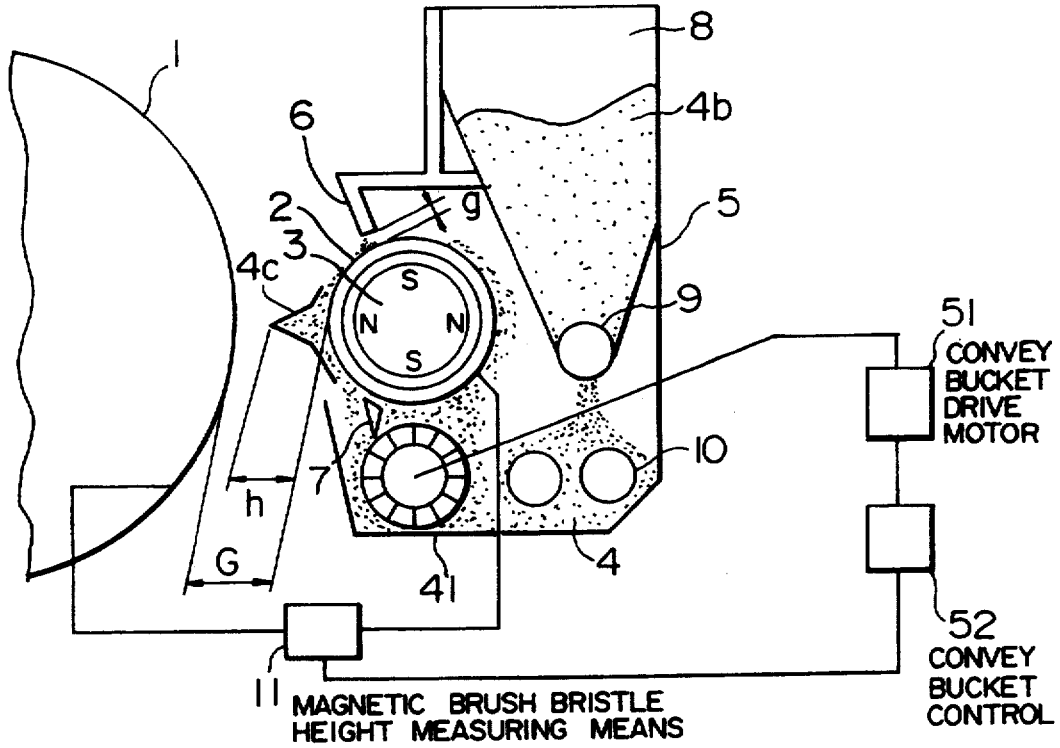
FIG. 11 is a side view showing a sixth embodiment of the developing apparatus according to the invention in which the magnetic brush bristle height is adjusted through rotation speed control of the convey bucket.

FIG. 11 illustrates a sixth embodiment of the developing apparatus in which a bristle height h of magnetic brush 4c can be adjusted by controlling the rotation speed of a convey bucket.

Developer 4 in a developing container 5 is stirred and mixed by a stirring means 10, pumped up by a convey bucket 41 so as to be fed to the surface of a developing sleeve 2 and adsorbed on the surface of the developing sleeve 2 under the influence of magnetic force of a magnet roller 3 to form a magnetic brush 4c. The bristle height h of the magnetic brush 4c is on the one hand regulated in accordance with the magnitude of regulator plate gap g but on the other hand, when the rotation speed of the convey bucket 41 is changed to change the amount of developer fed to the developing sleeve 2, the amount of developer 4 to be conveyed to a regulator plate 6 is changed to change the flow pressure of the developer 4 at the regulator plate gap g. As a result, the amount of developer 4 passing through the regulator plate gap g is changed to change the bristle height h of the magnetic brush 4c. Specifically, as the rotation speed of the convey bucket 41 increases to increase the amount of developer fed to the developing sleeve 2, the bristle height h of the magnetic brush 4c tends to increase. The present embodiment takes advantage of this phenomenon in order to adjust the bristle height h of the magnetic brush 4c and features the provision of a convey bucket control 52 which controls the rotation speed of a convey bucket drive motor 51 on the basis of the results of measurement by a brush bristle height measuring means 11 to make the developing gap G substantially equal to the bristle height h.

Figure 12:
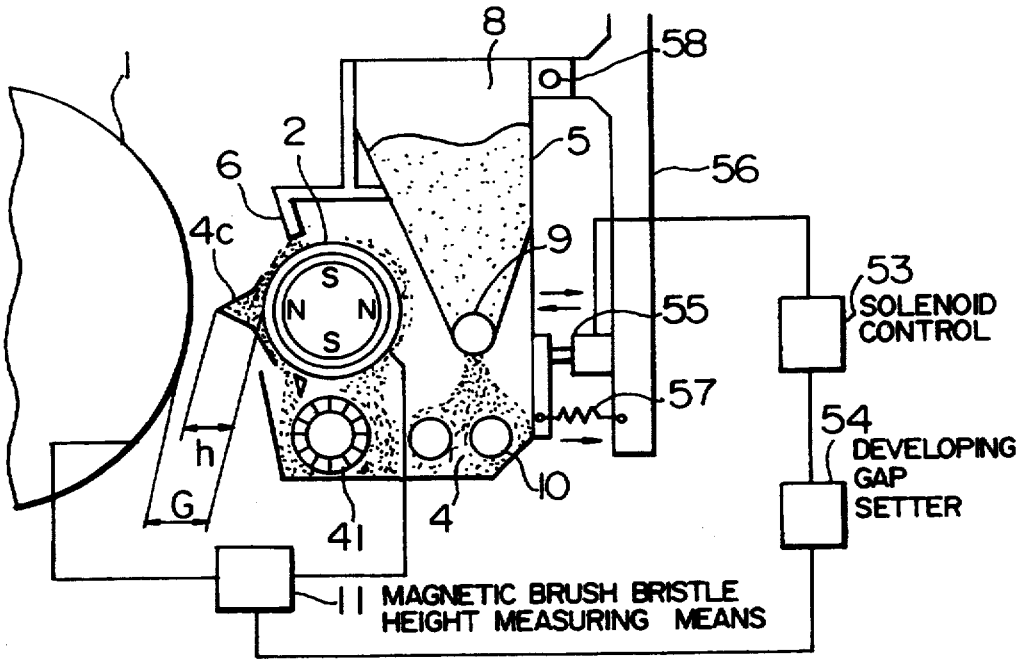
FIG. 12 is a side view showing a seventh embodiment of the developing apparatus according to the invention in which the developing gap can be adjusted by moving the developing container.

FIG. 12 illustrates a seventh embodiment of the developing apparatus in which developing gap G can be adjusted by moving a developing container 5. In the developing apparatus, an upper portion of a developing container 5 is rotatably mounted on a pivot 58 secured to a printer body frame 56 and its lower portion is urged against a solenoid type telescopic rod 55 by the action of a tension spring 57, whereby the developing gap G can be changed by actuating the solenoid type telescopic rod 55 to rotate the developing container 5. As in the precedence, the actuation control of the solenoid type telescopic rod 55 can be realized by operating a magnetic brush bristle height measuring means 11 which measures the relative relationship between the developing gap G and bristle height h and a developing gap setter 54 which sets a developing gap G on the basis of the measurement results and controls drive current delivered out of a solenoid control 53.

The developing gap setter 54 sets the developing gap G such that the bristle height h of the magnetic brush 4c substantially equals the developing gap G.

Figure 13:
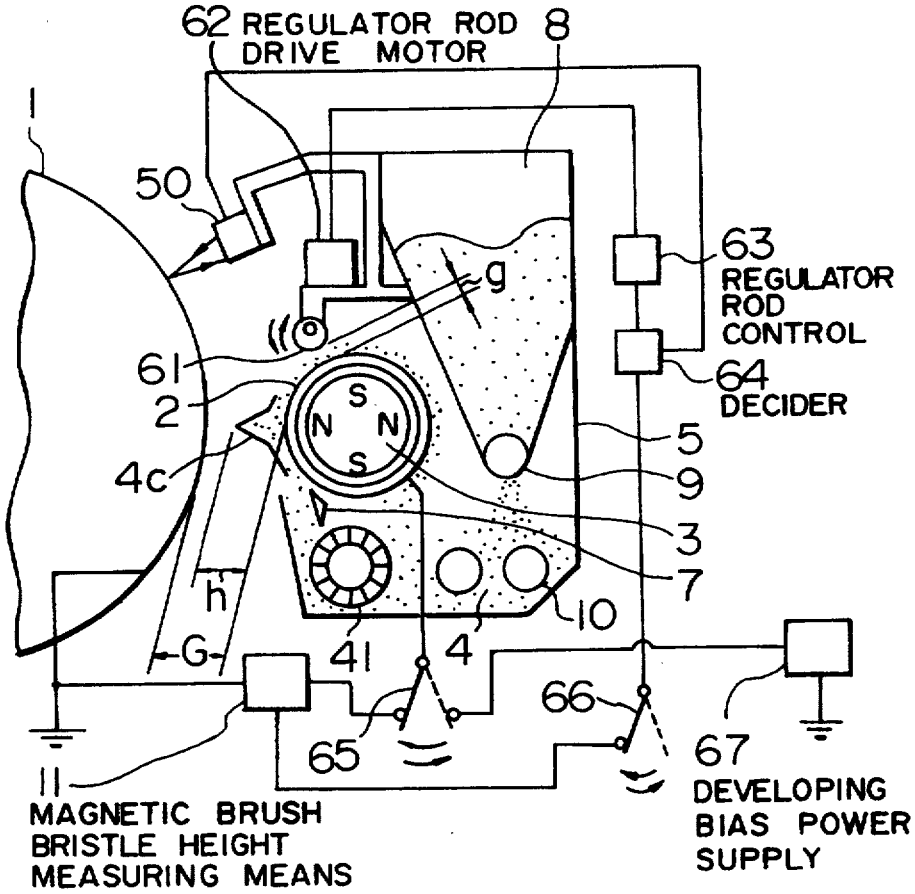
FIG. 13 is a side view showing an eighth embodiment of the developing apparatus according to the invention in which the regulator plate gap is regulated by means of the regulator rod in the form of an eccentric cam.

FIG. 13 illustrates an eighth embodiment of the developing apparatus in which a regulater plate gap g can be regulated by a regulator rod 61 in the form of an eccentric cam. In order to develop latent images with fidelity, the bristle height h of magnetic brush 4c needs to be adjusted with high accuracies. The regulator rod 61 is driven for rotation by a regulator rod drive motor 62 to adjust the developing gap g delicately.

In order to control the regulator rod drive motor, a magnetic brush bristle height measuring means 11 measures the bristle height h and a contactless gap measuring means 50 measures the distance between the developing apparatus and sensitive drum in advance. A decider 64 receives the measurement results to decide the developing condition and on the basis of the decision results, a regulator rod control 63 controls the rotation of the regulator rod drive motor 62.

In the present embodiment, circuit switches 65 and 66 are additionally provided to establish such a connection circuit that the magnetic brush measuring means 11 is made to be valid for bristle height measurement only in a non-development mode, and to establish such a connection circuit that developing bias voltage is supplied from a developing bias power supply 67 other than the magnetic brush measuring means 11 in the development mode. This ensures that the bias voltage applied between the sensitive drum 1 and developing sleeve 2 can be set to values optimized for bristle height measuring mode and development mode, respectively.

Figure 14:
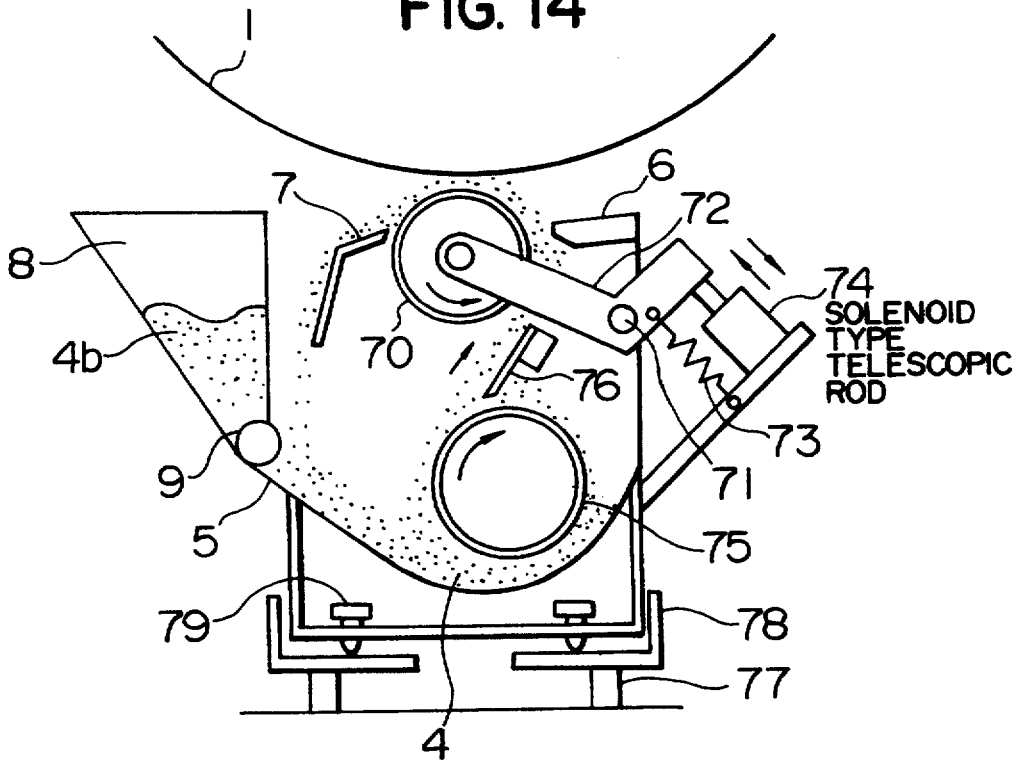
FIG. 14 is a side view showing a ninth embodiment of the developing apparatus of the invention in which the developing gap can be adjusted using the developing roller which is movable independently of the developing container.

FIG. 14 illustrates a ninth embodiment of the developing apparatus in which the developing gap can be adjusted by moving a developing roller 70 comprising a developing sleeve and a magnet roller in combination, independently of a developing container 5. In large-scale developing apparatus, movement of the entirety of developing container for the adjustment of the developing gap faces much difficulties and the construction of this embodiment can be applied to such large-scale apparatus to advantage.

The developing roller 70 is rotatably mounted to one end of an arm 72 rotatably supported on a pivot 71 and the other end of the arm 72 is urged against a solenoid type telescopic rod 74 by the action of a tension spring 73, whereby the developing gap can be changed by actuating the solenoid type telescopic rod 74 to rotate the arm 72. The actuation control of the solenoid type telescopic rod 74 can be realized, as in the precedence, by measuring the relative relationship between developing gap G and bristle height h by means of a magnetic brush bristle height measuring means and controlling drive current on the basis of the results of measurement by means of a solenoid control.

Developer 4 in a developing container 5 is adsorbed on the surface of a rotating developer supply roller 75 and is rotated so as to be fed to the developing roller 70 through a developer guide 76. The developing container 5 is mounted to a support base 78 on conveyance rollers 77 through positioning members 79.

Figure 15:
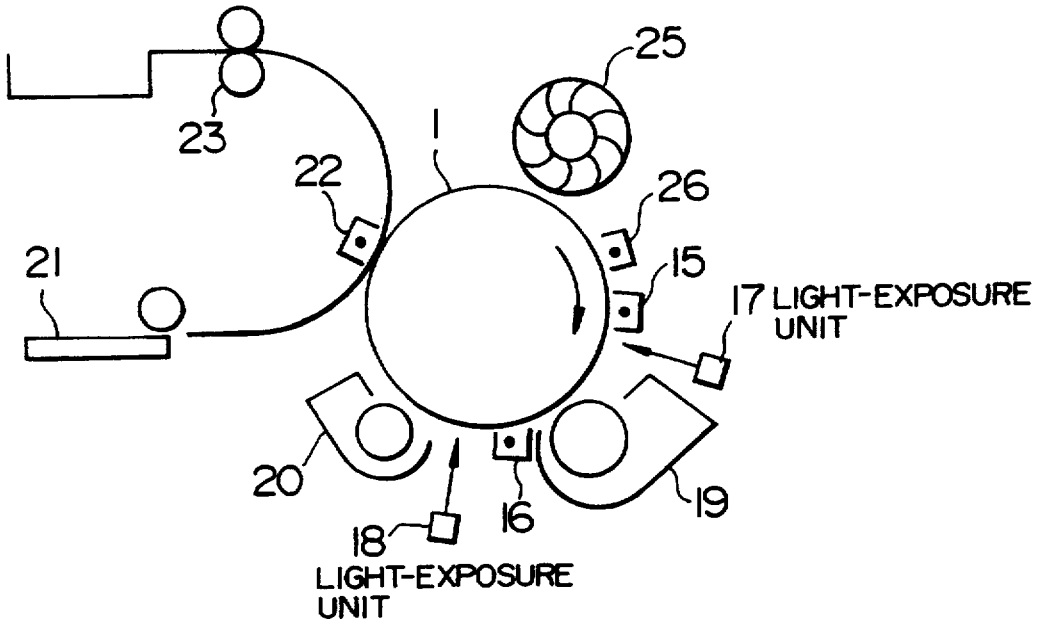
FIGS. 15 and 16 are side views showing embodiments of a laser beam exposure type two-color image printer according to the invention in which the size of the developing units is changed depending upon the kind of color of developer used.
Figure 16:
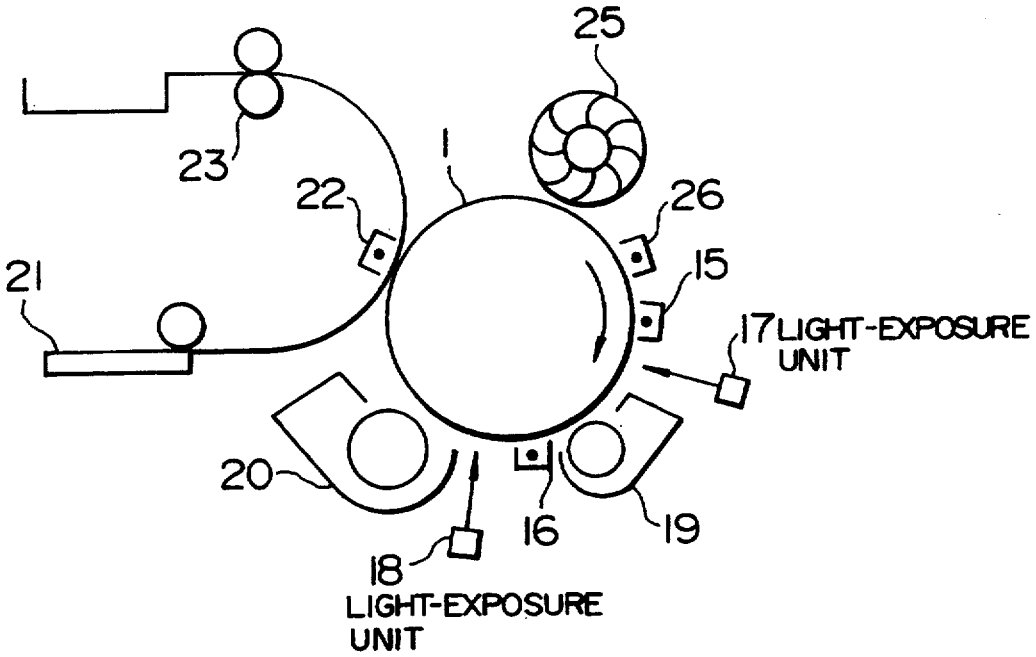

FIGS. 15 and 16 illustrate two kinds of laser beam exposure type two-color image printers in which the size of the developing unit is changed depending on color of developer used. In the two-color image printer described with reference to FIG. 3, the size of the developing units 19 and 20 is not particularly taken into consideration. Typically, however, image data delivered out of information processors such as computers is of black tone in many applications and black toner is used as a developer in great amounts.

In a two-color image printer shown in FIG. 15, a first developing unit 19 of large size is used with black developer and a second developing unit 20 of small size is used with colored (other than black) developer. Conveniently, the second developing unit 20 for use with color developer is so designed as to be easily detachable in order that a unit used with a developer of one color can be exchanged with another unit to be used with a developer of different a color. From the standpoint of the adjustment of the relative relationship between developing gap G and magnetic brush bristle height h to be effected in the second developing unit as described previously with the aim of preventing decrease in image density and color mixing, the second developing unit 20 is advantageous, particularly, for the adjustment of developing gap G because thanks to its small size and weight, it can adopt any desired one of the adjusting mechanisms.

In a two-color image printer shown in FIG. 16, a first developing unit 19 is reduced in size for use with color (other than black) developer and a second developing unit 20 is increased in size for use with black developer. The use of the second developing unit 20 with black developer is particularly advantageous since the black developer is immune from color mixing. From the standpoint of the adjustment of the relative relationship between developing gap G and magnetic brush bristle height h to be effected in the second developing unit as described previously with the aim of preventing decrease in image density and color mixing, it is advantageous for the second developing unit 20 to adopt, for adjustment of developing gap G, the developing roller positioning mechanism as described with reference to FIG. 14 because of its large size.

Figure 17:
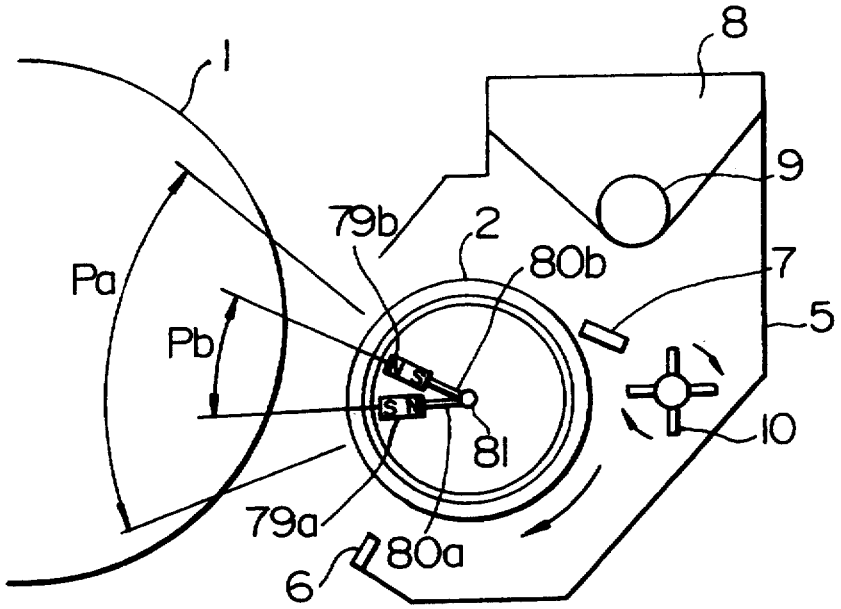
FIG. 17 is a side view showing a tenth embodiment of the developing apparatus of the invention which uses a modified magnetic brush bristle height adjusting mechanism.

FIG. 17 illustrates a tenth embodiment of the developing apparatus in which the magnetic brush bristle height adjusting mechanism is modified. The bristle height of magnetic brush at the developing portion changes also with the pitch between magnetic poles existing at that developing portion inside the developing sleeve. The present embodiment takes advantage of this phenomenon.

Two magnets 79a and 79b forming developing magnetic poles inside a developing sleeve 2 are secured to arms 80a and 80b pivotally mounted on a shaft 81 so that the pitch, P, between the two magnetic poles may be changed. The magnetic pole pitch P between the two magnets 79a and 79b can be adjusted by the angle between the magnets 79a and 79b.

Figure 18:
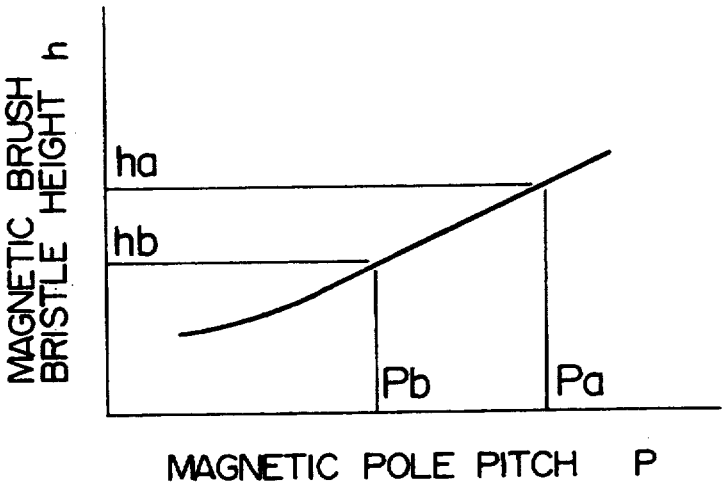
FIG. 18 is a graph useful to explain the relation between the magnetic pole pitch and the magnetic brush bristle height.

By changing the pitch P between the two magnets 79a and 79b, the bristle height h of magnetic brush can be changed as shown in FIG. 18. Accordingly, like the developing apparatus described previously, the FIG. 17 developing apparatus can be used as a second developing unit of the two-color image printer.

While in the foregoing embodiments the magnetic brush bristle height is measured by the magnetic brush bristle height measuring means and control is effected for bristle height adjustment and developing gap adjustment on the basis of the results of the measurement, the following control schemes may also be adopted to attain similar effects.

(1) A developing current measuring means is provided and control is conducted wherein the aforementioned adjusting mechanism is utilized to adjust the bristle height or the developing gap such that developing current measured by the developing current measuring means substantially equals the value of developing current in the contactless developing mode.

(2) A magnetic brush slide-contact force sensor is provided and control is conducted wherein the aforementioned adjusting mechanism is utilized to adjust the bristle height or the developing gap such that slide-contact force of the magnetic brush detected by the sensor becomes substantially zero.

(3) A toner image density sensor is provided and control is effected such that the aforementioned adjusting mechanism is utilized to adjust the bristle height or the developing gap such that values of image density for the first and second toner images detected by the sensor exceed a desirable level.

In order that the amount of toner particles of the first toner image scraped off upon development of the second latent image by the second developing unit 20 can be reduced in the two-color image printer described previously, it suffices that adherence force of the first toner image to the sensitive drum be increased. To this end, the particulate size of developer toner particles used for the first developing unit may be made to be smaller than the particulate size of developer toner particles used for the second developing unit. Preferably, this expedient may be used in combination with the aforementioned adjustment of the relative relationship between the developing gap and bristle height to enhance the effects of the invention.

Also, making the magnetic brush of the second developing unit 20 soft is effective to mitigate scrape-off of the first toner image. To this end, the saturated magnetizing force of developer carrier used for the second developing unit may be made to be smaller than the saturated magnetizing force of developer carrier used for the first developing unit. Again, this expedient may preferably be used in combination with the aforementioned adjustment of the relative relationship between the developing gap and bristle height to enhance the effects of the invention.

In the event that the above expedients cause characteristics of the first developer toner to differ from those of the second developer toner and there occurs irregularity in transfer upon transfer of toner image, roller transfer process or belt transfer process in which irregularity in transfer hardly occurs may preferably be used in combination with the developing apparatus.

The present invention has been described as applied to the second developing unit of the two-color image printer but the invention may be applied to all developing units following the second developing unit inclusive in a color image printer of two or more kinds of color to bring about remarkable effects and may also be applied to the first developing unit (or applicable to monochromatic image printers).

As described above, since, according to the invention, the bristle height of the magnetic brush formed of developer is set to be substantially equal to the developing gap to ensure that a latent image can be developed to form a toner image by making the tip of the magnetic brush slide-contact the surface of the latent image carrier lightly, a toner image formed precedently will not be scraped off to prevent reduction in image density, and the occurrence of color mixing and fog due to intrusion of the toner into the developing means can be prevented, thus providing toner images of sufficient density. The invention is well adapted to provide method and apparatus adapted for attaining the above effects.

We claim:

1. A developing method in which a developer containing magnetic particles is carried on a developer carrier to form a magnetic brush and a latent image on a latent image carrier opposing said developer carrier is developed by said magnetic brush, wherein said magnetic brush has a bristle height, of bristles not limited by contact with the latent image carrier, such that $-0.3\ mm \leqq G-h \leqq 0$, where G is the gap between the developer carrier and the latent image carrier and h is the bristle height of bristles of said magnetic brush which are not limited by contact with the latent image carrier, whereby a contact developing method is provided.

2. A developing method in which a second latent image on a latent image carrier having thereon a first toner image formed by developing a first latent image is developed by a magnetic brush formed of a developer containing magnetic particles on a developer carrier to form a second toner image, wherein the magnetic brush has a bristle height, of bristles not limited by contact with the latent image carrier, such that $-0.3\ mm \leqq G-h \leqq 0$, where G is the gap between the developer carrier and the latent image carrier for formation of said second toner image and h is the bristle height of bristles of said magnetic brush which are not limited by contact with the latent image carrier, whereby a contact developing method is provided.

3. A developing method according to claim 1 wherein the developing gap is regulated by developing gap regulating means to be substantially equal to the bristle height of said magnetic brush.

4. A developing method according to claim 2 wherein the developing gap is regulated by developing gap regulating means to be substantially equal to the bristle height of said magnetic brush.

5. A developing method in which an electrically conductive developer containing magnetic particles is carried on a developer carrier to form a magnetic brush and a latent image on a latent image carrier opposing said developer carrier is developed by said magnetic brush, wherein a bristle height of said magnetic brush, and the developing gap, are so set that electrical resistance between said developer carrier and latent image carrier due to said magnetic brush interposed between said developer carrier and latent image carrier has a value near a point of inflection on a curve of the electrical resistance as a function of the developing gap, but does not exceed the point of inflection.

6. A developing method in which a second latent image on a latent image carrier having thereon a first toner image formed by developing a first latent image is developed by a magnetic brush formed of a developer containing magnetic particles on a developer carrier to form a second toner image, wherein a bristle height of bristles of said magnetic brush, and the developing gap, are so set that electrical resistance between said developer carrier and latent image carrier due to said magnetic brush interposed between said developer carrier and latent image carrier has a value near a point of inflection on a curve of the electrical resistance as a function of the developing gap, but does not exceed said point of inflection.

7. A developing method according to claim 5 wherein said point of inflection is a point at which the electrical resistance begins to decrease from the maximum value.

8. A developing method according to claim 6 wherein said point of inflection is a point at which the electrical resistance begins to decrease from the maximum value.

9. A developing method according to claim 5 wherein the magnitude of said electrical resistance is determined on the basis of the magnitude of a developing current flowing between said developer carrier and latent image carrier.

10. A developing method according to claim 6 wherein the magnitude of said electrical resistance is determined on the basis of the magnitude of a developing current flowing between said developer carrier and latent image carrier.

11. A developing method in which a developer containing magnetic particles is carried on a developer carrier to form a magnetic brush and a latent image on a latent image carrier opposing said developer carrier is developed by said magnetic brush, wherein a bristle height of said magnetic brush, and the developing gap, are so set that frictional force exerted by said magnetic brush on said latent image carrier has a value substantially near a point of inflection on a curve of the frictional force as a function of the developing gap.

12. A developing method in which a second latent image on a latent image carrier having thereon a first toner image formed by developing a first latent image is developed by a magnetic brush formed of a developer containing magnetic particles on a developer carrier to form a second toner image, wherein a bristle height of said magnetic brush, and the developing gap, are so set that frictional force exerted by said magnetic brush on said latent image carrier has a value substantially near a point of inflection on a curve of the frictional force as a function of the developing gap.

13. A developing method according to claim 11 wherein said point of inflection is a point at which the frictional force becomes substantially zero.

14. A developing method according to claim 12 wherein said point of inflection is a point at which the frictional force becomes substantially zero.

15. A developing method in which a developer containing magnetic particles is carried on a developer carrier to form a magnetic brush and a latent image on a latent image carrier is developed by said magnetic brush, wherein the magnetic brush contacts the latent image carrier during development, such that $-0.3\ mm \leqq G-h \leqq 0$, where G is the gap between the developer carrier and the latent image carrier during development, and h is the bristle height of bristles of said magnetic brush which are not limited by contact with the latent image carrier, whereby a contact developing method is provided, and wherein a bristle height of the magnetic brush is determined, and wherein said bristle height is so controlled, that image density exceeds substantially a predetermined value.

16. A developing method in which a second latent image on a latent image carrier having thereon a first toner image formed by developing a first latent image is developed by a magnetic brush formed of a developer containing magnetic particles on a developer carrier to form a second toner image, wherein the magnetic brush contacts the latent image carrier during formation of the second toner image, such that $-0.3\ mm \leqq G-h \leqq 0$, where G is the gap between the developer carrier and the latent image carrier, during formation of the second toner image, and h is the bristle height of bristles of said magnetic brush which are not limited by contact with the latent image carrier, whereby a contact developing method is provided, and wherein a bristle height of said magnetic brush is determined, and wherein said bristle height is so controlled, that image density levels for the first and second developments exceed substantially predetermined values.

17. A developing method in which a developer containing magnetic particles is carried on a developer carrier to form a magnetic brush and a latent image on a latent image carrier opposing said developer carrier is developed by said magnetic brush, a developing gap being formed between the developer carrier and the latent image carrier, bristles of the magnetic brush contacting the latent image carrier, such that $-0.3\ mm \leqq G-h \leqq 0$, where G is the developing gap between the developer carrier and the latent image carrier, and h is the bristle height of bristles of said magnetic brush which are not limited by contact with the latent image carrier, whereby a contact developing method is provided, wherein the developing gap is determined, and wherein the developing gap is so controlled, that image density exceeds substantially a predetermined value.

18. A developing method in which a second latent image on a latent image carrier having thereon a first toner image formed by developing a first latent image is developed by a magnetic brush formed of a developer carrier containing magnetic particles on a developer carrier to form a second toner image, a developing gap being formed between the developer carrier and the latent image carrier, bristles of the magnetic brush contacting the latent image carrier, such that $-0.3\ mm \leqq G-h \leqq 0$, where G is the developing gap between the developer carrier and the latent image carrier, during formation of the second toner image, and h is the bristle height of bristles of the magnetic brush which are not limited by contact with the latent image carrier, whereby a contact developing method is provided, wherein the developing gap is determined, and wherein the developing gap is so controlled that image density levels for the first and second developments exceed substantially predetermined values.

19. A color image printing method in which a first latent image on a latent image carrier is developed by a first magnetic brush formed of a first developer containing magnetic particles on a first developer carrier to form a first toner image and a second latent image on said latent image carrier formed with said first toner image is developed by a second magnetic brush formed of a second developer containing magnetic particles on a second developer carrier to form a second toner image, wherein the second magnetic brush has a bristle height, of bristles not limited by contact with the latent image carrier, such that $-0.3\ mm \leqq G-h \leqq 0$, where G is the gap between the second developer carrier and the latent image carrier and h is the bristle height of bristles of said second magnetic brush which are not limited by contact with the latent image carrier, whereby a contact developing method is provided.

20. A color image printing method in which a first latent image carrier is developed by a first magnetic brush formed of a first developer containing magnetic particles on a first developer carrier to form a first toner image and a second latent image on said latent image carrier formed with said first toner image is developed by a second magnetic brush formed of a second developer containing magnetic particles on a second developer carrier to form a second toner image, wherein the first and second magnetic brushes respectively have bristle heights, of bristles not limited by contact with the latent image carrier, such that $-0.3\ mm \leqq G_1-h_1 \leqq 0$ and $-0.3\ mm \leqq G_2-h_2 \leqq 0$, where $G_1$ and $G_2$ respectively are the gaps between the first and second developer carriers and the latent image carrier and $h_1$ and $h_2$ respectively are the bristle heights of bristles of said first and second magnetic brushes which are not limited by contact with the latent image carrier, whereby a contact developing method is provided.

21. A color image printing method according to claim 19 wherein the average particulate size of toner of said second developer is substantially larger than the particulate size of toner of said first developer.

22. A color image printing method according to claim 20 wherein the average particulate size of toner of said second developer is substantially larger than the particulate size of toner of said first developer.

23. A color image printing method according to claim 19 wherein the saturated magnetization of magnetic particles of said second developer is substantially smaller than the saturated magnetization of magnetic particles of said first developer.

24. A color image printing method according to claim 20 wherein the saturated magnetization of magnetic particles of said second developer is substantially smaller than the saturated magnetization of magnetic particles of said first developer.

25. A developing apparatus having a developer carrier for carrying a developer containing magnetic particles to form a magnetic brush, and means for forming a developing gap through which said magnetic brush opposes a latent image carrier carrying a latent image so that said latent image may be developed by said magnetic brush, said apparatus comprising:

means for making a bristle height of bristles of said magnetic brush which are not limited by contact with the latent image carrier such that $-0.3\ mm \leqq G-h \leqq 0$, where G is the gap between the developer carrier and the latent image carrier and h is the bristle height of bristles of said magnetic brush which are not limited by contact with the latent image carrier, so as provide contact development of the latent image.

26. A developing apparatus having a latent image carrier for carrying a first toner image formed by developing a first latent image and a second latent image, and a developer carrier for carrying a magnetic brush formed of a developer containing magnetic particles so that said second latent image may be developed by said magnetic brush to form a second toner image, said apparatus comprising:

means for making a bristle height of bristles of said magnetic brush which are not limited by contact with the latent image carrier such that $-0.3\ mm \leqq G-h \leqq 0$, where G is the gap between the developer carrier and the latent image carrier and h is the bristle height of bristles of said magnetic brush which are not limited by contact with the latent image carrier, so as to provide contact development of the first and second latent images.

27. A developing apparatus having a developer carrier for carrying an electrically conductive developer containing magnetic particles to form a magnetic brush, and means for forming a developing gap through which said magnetic brush opposes a latent image carrier carrying a latent image so that said latent image may be developed by said magnetic brush, said apparatus comprising:

means for determining electrical resistance between said developer carrier and latent image carrier due to said magnetic brush interposed between said developer carrier and latent image carrier; and adjusting means for adjusting the relative value between a bristle height of said magnetic brush and the developing gap such that the electrical resistance has a value near a point of inflection on a curve of the electrical resistance as a function of the developing gap.

28. A developing apparatus having a developer carrier for carrying a developer containing magnetic particles to form a magnetic brush, and means for forming a developing gap through which said magnetic brush opposes a latent image carrier carrying a latent image so that said latent image may be developed by said magnetic brush, said apparatus comprising:

means for determining frictional force between said latent image carrier and said magnetic brush interposed between said developer carrier and said latent image carrier; and adjusting means for adjusting values of a bristle height of said magnetic brush and the developing gap, such that the frictional force exerted by said magnetic brush on said latent image carrier has a value near a point of inflection on a curve of the frictional force as a function of the developing gap.

29. A developing apparatus having a latent image carrier for carrying a first toner image formed by developing a first latent image and a second latent image, and a developer carrier for carrying a magnetic brush formed of a developer containing magnetic particles so that said second latent image may be developed by said magnetic brush to form a second toner image, said apparatus comprising:

means for determining frictional force between said latent image carrier and said magnetic brush interposed between said developer carrier and said latent image carrier; and adjusting means for adjusting values of a bristle height of said magnetic brush, and the developing gap, such that the frictional force exerted by said magnetic brush on said latent image carrier has a value near a point of inflection on a curve of the frictional force as a function of the developing gap.

30. A developing apparatus having a developer carrier for carrying a developer containing magnetic particles to form a magnetic brush, and means for forming a developing gap through which said magnetic brush opposes a latent image carrier carrying a latent image so that said latent image may be developed by said magnetic brush, said apparatus comprising:

means for determining a bristle height of the magnetic brush; and control means for controlling the bristle height of said magnetic brush such that image density exceeds substantially a predetermined value.

31. A developing apparatus having a latent image carrier for carrying a first toner image formed by developing a first latent image and a second latent image, and a developer carrier for carrying a magnetic brush formed of a developer containing magnetic particles so that said second latent image may be developed by said magnetic brush to form a second toner image, said apparatus comprising:

means for determining a bristle height of the magnetic brush; and bristle height control means for controlling the bristle height of said magnetic brush such that image density levels for the first and second developments exceed substantially predetermined values.

32. A developing apparatus according to claim 26 wherein the average particulate size of toner of said developer for development of said second latent image is larger than the average particulate size of toner for said first toner image.

33. A developing apparatus according to claim 29 wherein the average particulate size of toner of said developer for development of said second latent image is larger than the average particulate size of toner for said first toner image.

34. A developing apparatus according to claim 31 wherein the average particulate size of toner of said developer for development of said second latent image is larger than the average particulate size of toner for said first toner image.

35. A developing apparatus having a developer carrier for carrying a developer containing magnetic particles to form a magnetic brush, and means for forming a developing gap through which said magnetic brush opposes a latent image carrier carrying a latent image so that said latent image may be developed by said magnetic brush, said apparatus comprising:

means for determining the developing gap between the latent image carrier and the developer carrier; and developing gap control means for controlling said developing gap such that image density exceeds substantially a predetermined value.

36. A color image printer having a first magnetic brush formed of a first developer containing magnetic particles on a first developer carrier and used for developing a first latent image on a latent image carrier to form a first toner image, and a second magnetic brush formed of a second developer containing magnetic particles on a second developer carrier and used for developing a second latent image on said latent image carrier to form a second toner image, said printer comprising:

means for making a bristle height of bristles of said second magnetic brush which are not limited by contact with the latent image carrier such that $-0.3\ \text{mm} \leqq G-h \leqq 0$, where G is the gap between the second developer carrier and the latent image carrier and h is the bristle height of bristles of said second magnetic brush which are not limited by contact with the latent image carrier, whereby contact development of the second latent image is provided.

37. A color image printer having a first magnetic brush formed of a first developer containing magnetic particles on a first developer carrier and used for developing a first latent image on a latent image carrier to form a first toner image, and a second magnetic brush formed of a second developer containing magnetic particles on a second developer carrier and used for developing a second latent image on said latent image carrier to form a second toner image, said printer comprising:

means for making bristle heights of bristles of said first and second magnetic brushes, which bristles are not limited by contact with the latent image carrier, such that $-0.3\ \text{mm} \leqq G_1-h_1 \leqq 0$ and $-0.3\ \text{mm} \leqq G_2-h_2 \leqq 0$, where $G_1$ and $G_2$ respectively are the gaps between the first and second developer carriers and the latent image carrier and $h_1$ and $h_2$ respectively are the bristle heights of bristles of said first and second magnetic brushes that are not limited by contact with the latent image carrier, whereby contact development of the first and second latent images is provided.

38. A color image printer according to claim 36 wherein the average particulate size of toner of said second developer is larger than the particulate size of toner of said first developer.

39. A color image printer according to claim 6 wherein the average particulate size of toner of said second developer is larger than the particulate size of toner of said first developer.

40. A color image printer according to claim 6 wherein the saturated magnetizing force of magnetic particles of said second developer is substantially smaller than the saturated magnetization of magnetic particles of said first developer.

41. A color image printer according to claim 37 wherein the saturated magnetizing force of magnetic particles of said second developer is substantially smaller than the saturated magnetization of magnetic particles of said first developer.

42. A bristle height measuring method of measuring the height of a magnetic brush formed of an electrically conductive developer on a developer carrier comprising:

disposing a detection electrode opposing the tip of said magnetic brush; and measuring the bristle height of said magnetic brush on the basis of the magnitude of a current flowing between said developer carrier and detection electrode through said magnetic brush.

43. A bristle height measuring apparatus of measuring the height of a magnetic brush formed of an electrically conductive developer on a developer carrier comprising:

a detection electrode disposed to oppose said magnetic brush;

bias voltage application means for applying a bias voltage between said developer carrier and detection electrode; and measuring means for measuring the bristle height of said magnetic brush on the basis of the magnitude of a current flowing between said developer carrier and detection electrode through said magnetic brush.

44. A developing method in which a developer containing magnetic particles is carried on a developer carrier to form a magnetic brush and a latent image on a latent image carrier opposing said developer carrier is developed by said magnetic brush, wherein said magnetic brush has a bristle height, of bristles not limited in length by contact with the latent image carrier, that is substantially equal to the developing gap such that $-0.3\ mm \leqq G-h \leqq 0$, where G is the gap between the developer carrier and the latent image carrier and h is the bristle height of bristles of said magnetic brush that are not limited in length by contact with the latent image carrier, and wherein the bristle height of said magnetic brush is regulated by magnetic brush bristle height measuring means to be substantially equal to the developing gap.

45. A developing method in which a second latent image on a latent image carrier having thereon a first toner image formed by developing a first latent image is developed by a magnetic brush formed of a developer containing magnetic particles on a developer carrier to form a second toner image, wherein said magnetic brush has a bristle height, of bristles not limited in length by contact with the latent image carrier, that is substantially equal to the developing gap upon development for formation of said second toner image, such that $-0.3\ mm \leqq G-h \leqq 0$, where G is the gap between the developer carrier and the latent image carrier and h is the bristle height of said magnetic brush, wherein the bristle height of said magnetic brush is regulated by magnetic brush bristle height measuring means to be substantially equal to the developing gap.

46. A bristle height measuring method according to claim 42 wherein the bristle height is measured on the basis of the magnitude of a current flowing between the developer carrier and detection electrode through the magnetic brush and detected to be an inflection point by changing a distance between the developer carrier and detection electrode.

47. A bristle height measuring apparatus according to claim 43 wherein the measuring means measures the bristle height on the basis of the magnitude of a current flowing between said developer carrier and the detection electrode through said magnetic brush and detected to be an inflection point by changing a distance between the developer carrier and the detection electrode.

48. A color image printing method according to claim 19 wherein the second toner image is of a different color than the first toner image.

49. A developing method according to claim 5 wherein the bristle height is adjusted, such that the bristle height is made to be substantially equal to the developing gap, by controlling a relative rotation speed of a magnetic roller and a developing sleeve of the developer carrier, and blocking rotation of the magnetic brush downstream of contact of the magnetic brush with the latent image carrier.

50. A developing method according to claim 5 wherein the bristle height is adjusted, such that the bristle height is made to be substantially equal to the developing gap, by adjusting a distance between a regulator plate and the developer carrier.

51. A developing method according to claim 1 wherein the bristle height is adjusted, such that the bristle height is made to be substantially equal to the developing gap, by adjusting a rotation speed of a convey bucket that conveys developer to the developer carrier.

52. A developing method according to claim 5 wherein the developing gap is adjusted, such that the bristle height is substantially equal to the developing gap, by moving a developing container containing the developer carrier.

53. A developing method according to claim 5 wherein the developing gap is adjusted, such that the bristle height is substantially equal to the developing gap, by moving the developer carrier on which the developer is carried.

54. A developing method according to claim 5 wherein the bristle height is adjusted, such that the bristle height is made to be substantially equal to the developing gap, by adjusting a pitch between magnetic poles of the developer carrier at a location where the latent image carrier opposes the developer carrier.

55. A developing method according to claim 5, wherein the developer carrier includes a magnet roller, the magnet roller having 16 to 30 magnetic poles.

56. A developing apparatus according to claim 27, wherein the means for adjusting the relative value between the bristle height and the developing gap is a means for adjusting said relative value such that the electrical resistance has a value near a point of inflection on a curve of the electrical resistance as a function of the developing gap, but not greater than said point of inflection.

57. A developing method according to claim 5, wherein the bristle height of the bristles not limited by contact with the latent image carrier, and the developing gap, are so set that $-0.3\ mm \leqq G-h \leqq 0$, where G is the developing gap and h is the bristle height of the bristles not limited by contact with the latent image carrier.

58. A developing method according to claim 6, wherein the bristle height of the bristles not limited by contact with the latent image carrier, and the developing gap, are so set that $-0.3\ mm \leqq G-h \leqq 0$, where G is the developing gap and h is the bristle height of the bristles not limited by contact with the latent image carrier.

59. A developing apparatus according to claim 27, wherein the bristle height of bristles of the magnetic brush that are not limited by contact with the latent image carrier, and the developing gap, are so set such that $-0.3\ mm \leqq G-h \leqq 0$, where G is the developing gap and h is the bristle height of the bristles that are not limited by contact with the latent image carrier.

60. A developing apparatus according to claim 28, wherein a bristle height of bristles of the magnetic brush that are not limited by contact with the latent image carrier, and the developing gap, are so set such that $-0.3\ mm \leqq G-h \leqq 0$, where G is the developing gap and h is the bristle height of the bristles not limited by contact with the latent image carrier.

61. A developing apparatus according to claim 29, wherein a bristle height of bristles of the magnetic brush that are not limited by contact with the latent image carrier, and the developing gap, are so set such that $-0.3\ mm \leqq G-h \leqq 0$, where G is the developing gap and h is the bristle height of the bristles not limited by contact with the latent image carrier.

62. A developing apparatus according to claim 30, wherein the bristle height, of bristles of the magnetic brush that are not limited by contact with the latent image carrier, and a developing gap between the latent image carrier and the developer carrier, are so set that $-0.3\ mm \leqq G-h \leqq 0$, where G is the developing gap and h is the bristle height of bristles of the magnetic brush that are not limited by contact with the latent image carrier.

63. A developing apparatus according to claim 31, wherein the bristle height, of bristles of the magnetic brush that are not limited by contact with the latent image carrier, and a developing gap between the latent image carrier and the developer carrier, are so set that $-0.3\ mm \leqq G-h \leqq 0$, where G is the developing gap and h is the bristle height of bristles of the magnetic brush that are not limited by contact with the latent image carrier.

64. A developing apparatus according to claim 35, wherein said magnetic brush has a bristle height of bristles that are not limited by contact with the latent image carrier, and the bristle height of the bristles that are not limited by contact with the latent image carrier, and developing gap, are so set that $-0.3\ mm \leqq G-h \leqq 0$, where G is the developing gap and h is the bristle height of the bristles that are not limited by contact with the latent image carrier.

65. A developing method according to claim 44 wherein the magnetic brush bristle height measuring means is a means for measuring the bristle height of the magnetic brush during rotation of a developing roll.

66. A developing method according to claim 45 wherein the magnetic brush bristle height measuring means is a means for measuring the bristle height of the magnetic brush during rotation of a developing roll.

67. A developing apparatus having a developer carrier for carrying a developer containing magnetic particles to form a magnetic brush, wherein the developer carrier includes a magnet roller, the magnet roller having 16 to 30 magnetic poles, and means for forming a developing gap through which said magnetic brush opposes a latent image carrier carrying a latent image so that said latent image may be developed by said magnetic brush, said apparatus further comprising:

means for making a bristle height of bristles of said magnetic brush that are not limited by contact with the latent image carrier, that is substantially equal to the developing gap, such that $-0.3\ mm \leqq G-h \leqq 0$, where G is that gap between the developer carrier and the latent image carrier and h is the bristle height of bristles of said magnetic brush that are not limited in length by contact with the latent image carrier.

68. A developing method according to claim 1, wherein during development of the latent image by the magnetic brush a developing bias voltage is applied, the developing bias voltage being a direct current bias voltage only.

69. A developing method according to claim 2, wherein during development of the second latent image by the magnetic brush a developing bias voltage is applied, the developing bias voltage being a direct current bias voltage only.

70. A developing method according to claim 15, wherein during development of the latent image by the magnetic brush a developing bias voltage is applied, the developing bias voltage being a direct current bias voltage only.

71. A developing method according to claim 16, wherein during development of the second latent image by the magnetic brush a developing bias voltage is applied, the developing bias voltage being a direct current bias voltage only.

72. A developing method according to claim 17, wherein during development of the latent image by the magnetic brush a developing bias voltage is applied, the developing bias voltage being a direct current bias voltage only.

73. A developing method according to claim 18, wherein during development of the second latent image by the magnetic brush a developing bias voltage is applied, the developing bias voltage being a direct current bias voltage only.

74. A color image printing method according to claim 19, wherein during development of the second latent image by the second magnetic brush a developing bias voltage is applied, the developing bias voltage being a direct current bias voltage only.

75. A color image printing method according to claim 20, wherein during development of the first and second latent images respectively by the first and second magnetic brushes, developing bias voltages are applied, the developing bias voltages being direct current bias voltages only.

76. A developing apparatus according to claim 25, further comprising means for applying a developing bias voltage during development of the latent image by the magnetic brush, said means for applying being a means for applying a direct current bias voltage only.

77. A developing apparatus according to claim 26, further comprising means for applying a developing bias voltage during development of the second latent image by the magnetic brush, said means for applying being a means for applying a direct current bias voltage only.

78. A color image printer according to claim 36, further comprising means for applying a developing bias voltage during development of the second latent image by the second magnetic brush, said means for applying being a means for applying a direct current bias voltage only.

79. A color image printer according to claim 37, further comprising means for applying a developing bias voltage during development of the first and second latent images respectively by the first and second magnetic brushes, said means for applying being a means for applying a direct current bias voltage only.

* * * * *